US005142957A

United States Patent [19]

Gallimore

[11] Patent Number: 5,142,957

[45] Date of Patent: Sep. 1, 1992

[54] ROTARY CUTTER

[75] Inventor: D. W. Gallimore, 9, Chantrell Road, Newton, West Kirby, Merseyside L48 9XR, United Kingdom

[73] Assignees: Dennis W. Gallimore; Stephen J. Gallimore, both of Merseyside, both of United Kingdom

[21] Appl. No.: 726,693

[22] Filed: Jul. 8, 1991

[30] Foreign Application Priority Data

Jul. 7, 1990 [GB] United Kingdom ..... 9015039

[51] Int. Cl.[5] ..... D01G 1/04

[52] U.S. Cl. ..... 83/117; 83/331; 83/672; 83/913

[58] Field of Search ..... 83/331, 659, 665, 672, 83/913, 117, 118

[56] References Cited

U.S. PATENT DOCUMENTS

| | | | |
|---|---|---|---|
| 3,333,498 | 8/1967 | Holm | 83/672 |
| 3,553,947 | 1/1971 | Fram | 83/913 |
| 4,063,479 | 12/1977 | Roncato | 83/913 |
| 4,083,279 | 4/1987 | Wester et al. | 82/913 |
| 4,253,363 | 3/1981 | Fram | 83/913 |
| 4,399,589 | 8/1983 | Hefti | 83/913 |
| 4,706,531 | 11/1987 | Blauhut et al. | 83/913 |

FOREIGN PATENT DOCUMENTS

| | | |
|---|---|---|
| 2182881 | 5/1987 | United Kingdom . |
| 2211456 | 7/1989 | United Kingdom . |

*Primary Examiner*—Frank T. Yost
*Assistant Examiner*—Allan M. Schrock
*Attorney, Agent, or Firm*—Dennison, Meserole, Pollack & Scheiner

[57] ABSTRACT

A device including at least one elongate slot having an elongate blade or vane secured therein, in which the slot when viewed in transverse cross section is curved and the blade or vane is resilient and normally flat in its unstressed condition out of said slot and has a portion securely locatable in said slot by the reactive pressures resulting from deformation of said portion to assume the curve of the slot when located therein.

25 Claims, 4 Drawing Sheets

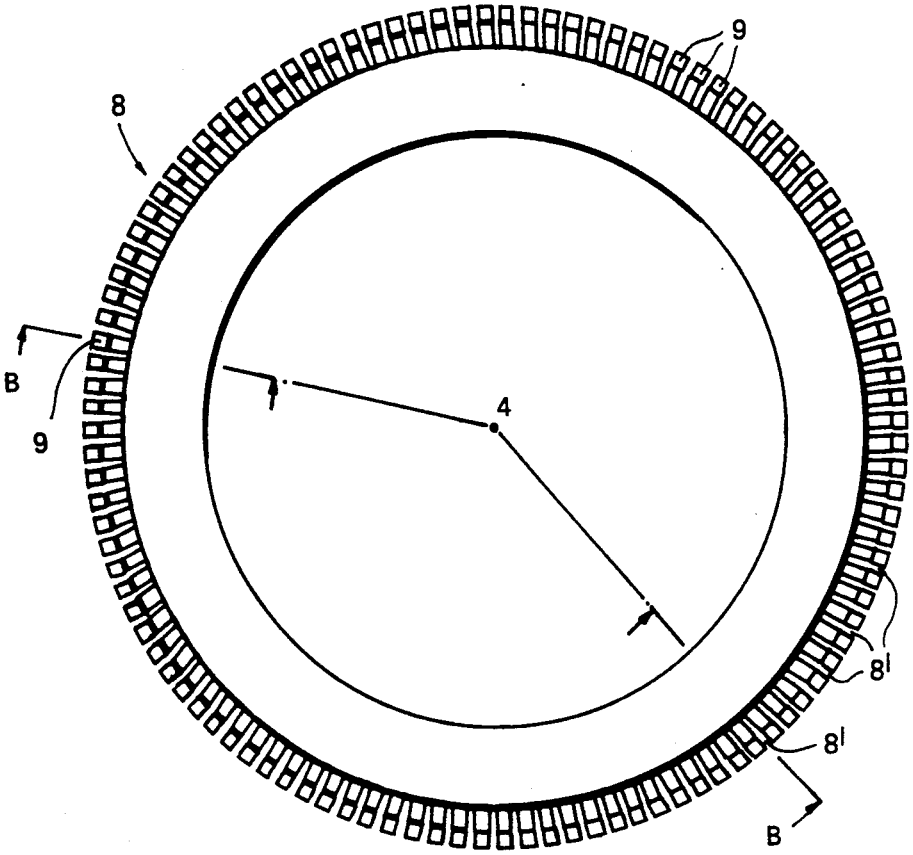
FIG. 5
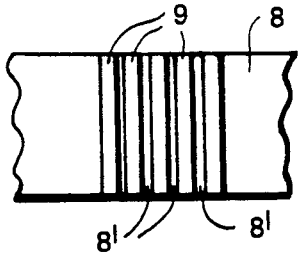
FIG. 6
FIG. 7
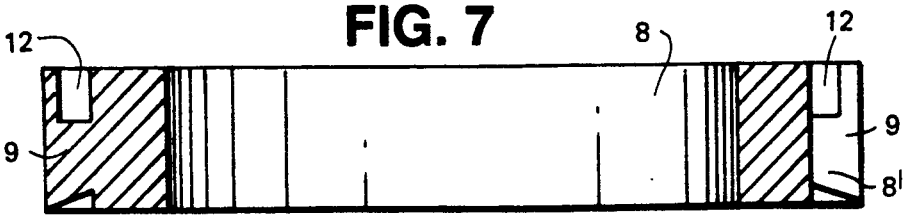

ROTARY CUTTER

The present invention primarily relates to a rotary cutter for a cutting apparatus for cutting or chopping short lengths of filament such as glass fibre strands from longer lengths thereof although in its broadest aspect relates to a means for locating a blade or vane member in a rotary body.

A rotary cutting apparatus is known including a rotatably mounted cylindrical cutter body which has a plurality of spaced apart parallel blade-receiving grooves or slots which are also parallel to the longitudinal axis of the cylindrical body of the cutter. The blade receiving slots are rectilinear and of such a width as to accommodate the rectilinear blade and an undulating locating spring which acts against a side wall of the slot and the side of blade to urge such against the other side wall and securely retain the blade in the slot although the blades may be replaced but with difficulty. The cutter is rotatably mounted in the apparatus and driven via a parallel axis, driven counter roller having a polypropylene outer jacket which abuts the edges of the cutting blades so that filaments fed between the cutter and counter roller are cut thereby. Such known arrangement is costly to produce because of the need for the undulating spring and, more importantly, the spaces in the slot and also between the blades tend to become blocked with filaments and waste dust and the cutter becomes less efficient and tends to overheat and be damaged as a consequence. Also, as the cutting effect decreases, the apparatus operators tend to adjust the position of the cutter to urge such further against the polypropylene drive and counter roller with consequential damage and decrease in efficiency. Also, the cutting edge of the blades of the known cutters is radial i.e. normal to the intersecting tangent to the cylindrical path travelled by the edge and such is not the most efficient angle for cutting the filaments.

According to the broadest aspect of the present invention a device includes at least one elongate slot having an elongate blade or vane secured therein, in which the slot when viewed in transverse cross section is curved and the blade or vane is resilient and normally flat in its unstressed condition out of said slot and has a portion securely locatable in said slot by the reactive pressures resulting from deformation of said portion to assume the curve of the slot when located therein.

Also according to the present invention an improved rotary cutter comprises a cylindrical body mountable so as to be rotatable about its central axis and having a plurality of spaced apart slots or grooves along its outer surface in which there are secured a plurality of resilient cutting blades which are normally flat in their unstressed condition out of said grooves and have a longitudinal cutting edge along one side; each of said slots or grooves being curved when viewed in transverse section and dimensioned such as to receive the edge of one said blades remote from the cutting edge and securely frictionally retain such by the reactive pressure resulting from the deformation or bending of said blade to assume the curve of said slot or groove when locating the blade therein.

The slots or grooves will extend longitudinally along the cylindrical body and may be straight and parallel to the rotary axis although preferably are helical about the rotary axis or formed as a helix which improves the cutting action and acts to avoid or minimize overheating of the blades. The curvature of the grooves will preferably be such as to incline the cutting edges of the blades in the direction of rotary movement of the cutter so that a more effective cutting angle is achieved.

It has been found with known cutters that cut fibres and fibre dust becomes trapped or accumulates on the plain cylindrical surface between the blades and builds up to such an extent as to impair the cutting action of the blades and also cause overheating.

According to another aspect of the present invention a rotary cutter comprises a cylindrical body mountable so as to be rotatable about its central axis and having a plurality of spaced apart cutting blades located thereon and extending therealong and having a plurality of ejector bars mounted in the spaces between the blades and extending with said blades, each said ejector bar being mounted in the space between two adjacent blades so as to be displaceable towards the central axis during the cutting operation and away from the central axis and towards the cutting edge of the blade after the cutting operation so as to act to prevent or minimize the build up of cut material between the blades.

Preferably the ejector bars will be incorporated in the above-described cutter having slots or grooves curved as viewed in transverse section to receive and retain resilient blades.

Preferably, the ejector bars will be displaceable in channels in the cylindrical body extending along the blades and forming the spaces between the blades with sufficient clearance for the bars to be freely displaceable.

Preferably, the ejector bars will be resiliently or spring biased into their outer position preferably by spring means at their opposite ends and preferably with a resilient or other damping means acting to stop the inward movement of the ejector bars.

Preferably the ejector bars will be guided at their opposite ends in a guide ring located at opposite ends of the cylindrical body having a plurality of radial or part helical or other outwardly open channels formed around the outer surface and indexable or alignable with the spaces or channels between the blades in which the ejector blades are inwardly and outwardly displaceable and alignable so as to be extensions of the adjacent end portions of the slots or grooves or the blades therein i.e. preferably formed at the same pitch as the helical disposition of the blades. Preferably an annular retaining end cap with a centrally directed flange will be located at each end of the cylindrical body over each said ring with the flange closing part of the open channels of the guide ring so as to retain the ejector bars and limit outward displacement thereof—preferably to not beyond the outer cutting edges of the blades.

It has been found that the bodies of known cylindrical cutters are sometimes accidentally damaged at one end, for example, by being dropped, and it is a further inventive feature of the present application to provide a rotary cutter having a two part cylindrical body for receiving the cutter blades with the blade receiving slots or grooves and spaces or channels of each part being alignable and held non-rotatably relative to each other to enable the blades and, optionally, the ejector bars when provided, to extend along the grooves or channels in the same manner as a one piece cylindrical body. If one part is damaged, then such may be readily replaced by another part which involves only half the material and/or labour. Instead of two half parts, any number of parts may be provided—possibly even protective end ring parts, as desired.

To enable the rotary cutter according to the present invention to be used in existing cutting apparatus with known rotary cutters wherein the blade and mounting cylinder have different sized and connecting shapes e.g. dog connections to a rotary mounting, the present invention also provides a composite rotary cutter having a cylindrical cutter body carrying the cutting blades, preferably in the manner of one or more of the previously described arrangements of the present invention optionally including ejector bars, with said body being tubular and forming an outer sleeve, preferably of hard steel, for an inner cylindrical mounting tube preferably of mild steel to which it is secured e.g. by being keyed thereto. The outer sleeve will be dimensioned sufficiently large as to enable the inner cylindrical mounting tube to be accordingly machined or formed so as to be mountable on an existing machine and the sizing of the outer sleeve will be such as to permit variations in the inner mounting tube to be sufficient to accommodate the different mountings of existing machines without having to machine a special sized outer sleeve in each case as such is the more expensive part.

It will be appreciated that the various aspects of the invention described above will preferably be combined together in a preferred arrangement comprising an outer cylindrical sleeve having said helically disposed grooves containing the arcuately deformed resilient blades secured by the inherent spring pressure thereof and having said displaceable ejector bars displaceable in the spaces between the blades with the ends of the bars guided and secured in aligned, slotted rings at each end of the sleeve and retained by annular end caps with said sleeve, rings and end caps being non-rotatably mounted on the inner mounting tube which is adapted to be mounted to be rotatable in a cutting apparatus.

It will be appreciated that insofar as the rotary cutter is for cutting filaments of, for example, glass fibre, the cutter, as mentioned as is known, is preferably juxtaposed against and drivable by a counter roller having a cylindrical outer sleeve of polypropylene. Cutting apparatus incorporating such cutters are marketed.

The invention will be described further, by way of example, with reference to the accompanying drawings, in which:

FIG. 5 is an end elevational view (photocopy) of a slotted end guide ring for the ejector bars;

FIG. 6 is a fragmentary side elevational view of part of the circumference of the ring of FIG. 5;

FIG. 7 is a section along the line B—B of FIG. 5;

Figure 1:
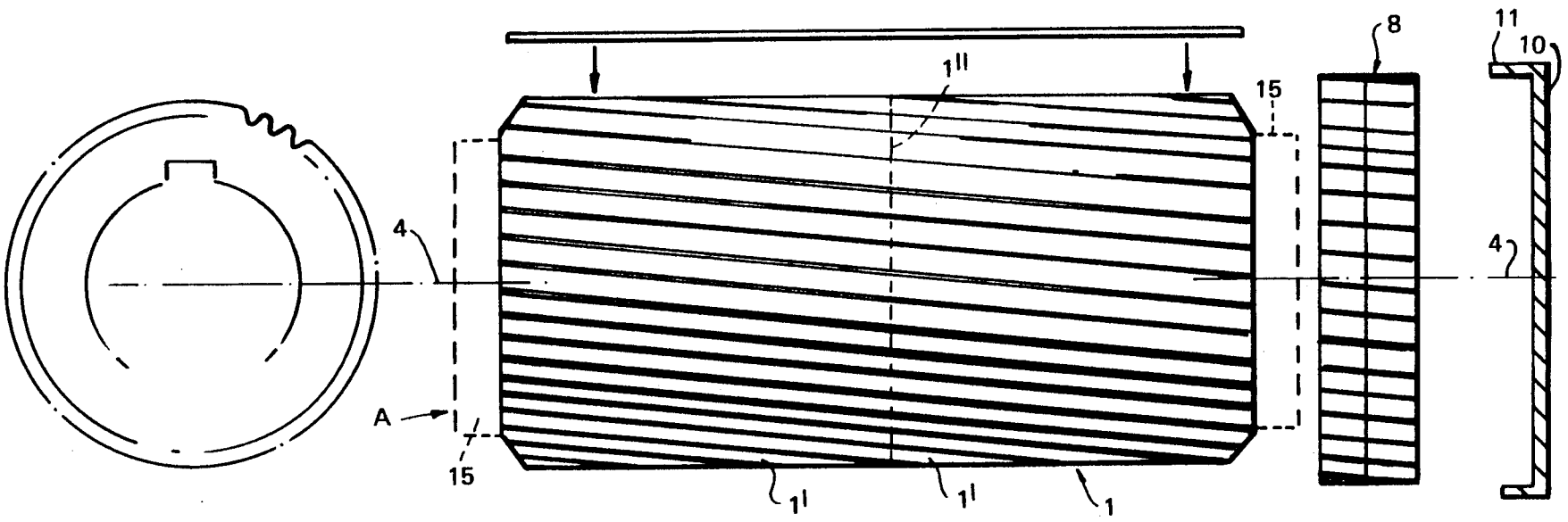
FIG. 1 is an elevation of a cylindrical cutter body in the form of a sleeve for receiving helically disposed cutter blades and ejector bars in helically disposed blade grooves and ejector bar spaces and having two identical end guide rings and annular end caps (only one end shown)
Figure 2:
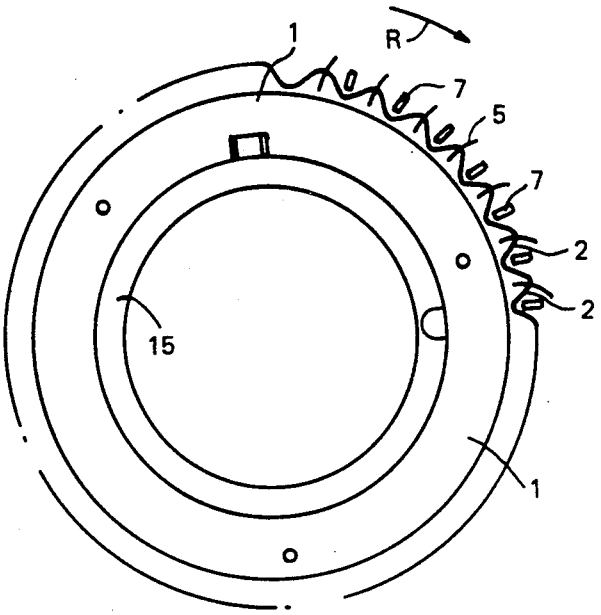
FIG. 2 is a schematic end elevation of the cutter body sleeve of FIG. 1 without guide ring or end cap also illustrating the end of an inner cylindrical mounting tube and only part of the outer surface of the sleeve with cutting blades and ejector bars.
Figure 3:
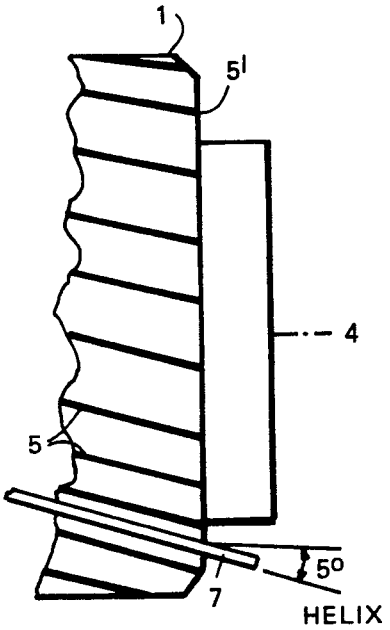
FIG. 3 is a schematic fragmentary elevation of one end of the cutter body of FIGS. 1 and 2 illustrating part of a single ejector bar.

A rotary cutter is illustrated in FIGS. 1 to 10 suitable for mounting in a cutting apparatus for filaments wherein rotor sleeve 1 is juxtaposed a jacketed rotary drive roller (not shown) and filaments fed into the space therebetween to be cut.

The rotary cutter comprises a cylindrical sleeve 1 formed as two identical parts 1' interfacing of 1'' preferably of EN8D steel, and having a helically fluted outer surface formed by a plurality of regularly spaced and parallel identical projecting portions 2 forming a helix with pitch at 5° to the central longitudinal axis 4 and extending helically along the length of the sleeve 1 with each having a groove 3 (FIG. 4) formed therein and running the length thereof in corresponding helical manner. Each groove 3 is arcuate when viewed in transverse cross section e.g. of a 18 mm radius, and securely receives a resilient cutting blade 5 which is normally flat in its unstressed state although when located in arcuate cross sectioned grooves 3 assumes a curved cross section and follows the helical path of groove 3. The cutting ends of the blades 5 project out of the groove 3 and are curved to lean in the direction of rotation (arrow R) to improve the cutting action. The blades 5 are located in grooves 3 with little clearance e.g. two thousandths of an inch, and are sufficiently resilient with respect to the cross sectional curvature of the grooves 3 as to be securely and frictionally engaged in the grooves 3 although may be removed and replaced if necessary.

Figure 4:
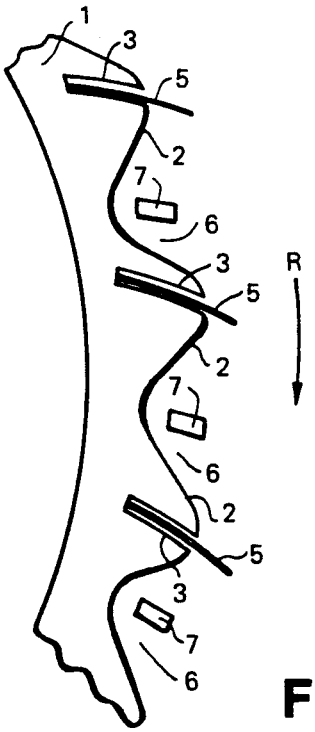
FIG. 4 is a fragmentary end elevational detail on enlarged scale of the cutter body sleeve of FIGS. 1 and 3, having cutter blades and ejector bars.

FIG. 4 is only schematic and diagramatic and the spacing and shaping is not accurate. The blades 5 will preferably be of high speed steel and in the form of flat strip blades of rectangular cross section with one lateral edge being sharpened into the cutting edge. The blades 5 terminate at the end 5' of the sleeve 1.

A space 6 is provided by the fluted outer surface between the projections 2 and in the schematic illustration of FIG. 4 are each of substantially V-shaped section, but may be of generally rectangular section, to accommodate with sufficient clearance an elongate ejector bar 7 of rectangular cross section and preferably of hardened and tempered spring steel. The bars 7 extend helically in the same manner as the blades 5 and are displaceably retained and guided at their opposite ends in annular oppositely facing guide rings 8 preferably of aluminium. As will be apparent from FIG. 5 for example, which is a photocopy of the ring and wherein the outer peripheral black rectangles 8' represent slots or spaces. In the left-hand part of FIG. 5, section line B—B passes through an arm 9 of the ring 8 whilst in the right-hand part, through a space 8'. A plurality of such helically extending arms 9 are provided around ring 8 and define helically extending spaces 8' which are alignable with spaces 6 of the sleeve 1 or at least the ends of the ejector bars 7 therein to permit the bars 7 to be displaceable in spaces 6 towards and away from axis 4 to act to keep spaces 6 clear of waste material. An annular end cap 10 (FIG. 8 and 9) preferably of hardened anodised steel and having an inwardly projecting annular rim or flange 11 is secured at each end of sleeve 1 at one part of rings 8 so that flange 11 extends inwardly of the ends of ejector bars 7 to retain such against outward displacement and preferably such that the outer edge of each ejector bar 7 cannot be diplaced outwardly beyond the end of the cutting edge of blades 5.

An annular recess 12 is formed in rings 8 on the side remote from the sleeve 1 and concentric with the ring. Each recess 12 receives a spring coil 13 or concentric annular spring 13 which acts outwardly on the respective end of ejector bar 7 to bias such outwardly. Two resilient rubber or like resilient rings 14 are provided radially inwardly of spring 13 and also act to bias bars 7 outwardly but also act to dampen the inward movement of bars 7 and prevent chatter and wear. The rings 8 are each provided with an undercut or inclined part end faces 15 cooperating with chamfers on the ends of sleeve 1 for sealing.

To enable sleeve 1 (parts 1') to be rotatably mounted in the cutting apparatus (not shown) it is non-rotatably mounted by suitable keying on a cylindrical mounting tube 15 extending therethrough as is ring 8 in alignment with the channels of the sleeve 1 and also end cap 10. The tube 15 will be suitably adapted to be mounted on an existing machine or on any machine. Tube 15 may be omitted if the sleeve 1 is one piece and the cutter not to be used to replace known cutters although is of advantage in any event.

Figure 10:
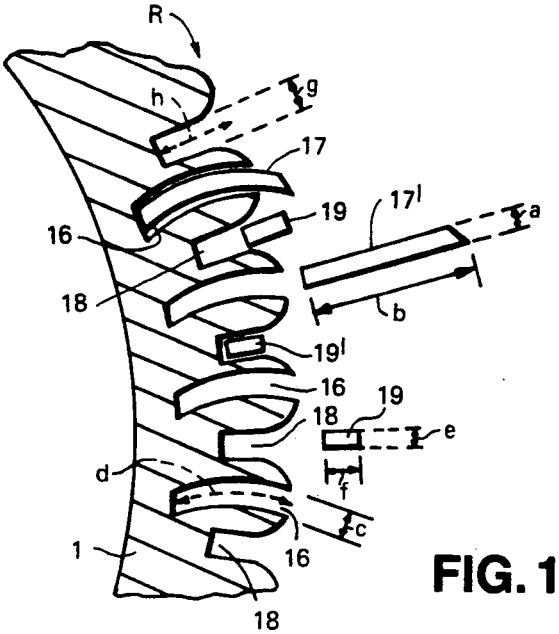
FIG. 10 is a view similar to FIG. 4 of a preferred arrangement of ejector bars and cutter blades.

In FIG. 10, a more detailed illustration, similar to FIG. 4 is given with dimensions by way of example, of a preferred embodiment wherein a plurality of elongate blades 17' are provided each of a thickness of a of 0.010 mm. width, b of 8 mm and a length of approx. 19 mm.

A plurality of arcuate grooves 16 diposed as a 5° helix (see FIG. 3) are provided and each are of an 18 mm radius being of a width c of 0.012 mm, a depth d of 6.7 mm. and length of 19 mm. The blades 17' are of hardened and tempered spring steel and when located in grooves 16 assume a curved shape (see blade 17) and are securely held therein against removal during use.

A plurality of rectangular ejector bars 19 are provide each of a thickness e of 1 mm. a width f of 3.5 mm and a length of approx. 20 mm. A plurality of rectangular section spaces or grooves 18 are provided each between adjacent blades 17 and are of a length of approx. 19 mm, a width h of 3.6 mm and a thickness g of 1.2 mm at the mouth reducing to 1.1 mm at the base. The blade pitch or spacing may be 3, 4, 5, 6, 9, 12 or 25 mm to chop corresponding lengths of fibre.

Figure 8:
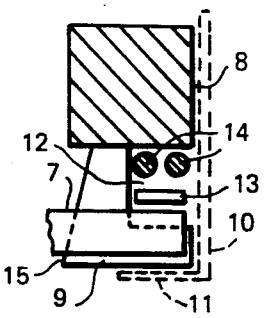
FIG. 8 is an enlarged fragmentary cross sectional detail of part of the guide ring of FIGS. 5 to 7 also illustrating the top of one ejector bar located in its slot and biassed to be displaced outwardly by a ring spring back by two resilient biassing and damping rings.
Figure 9:
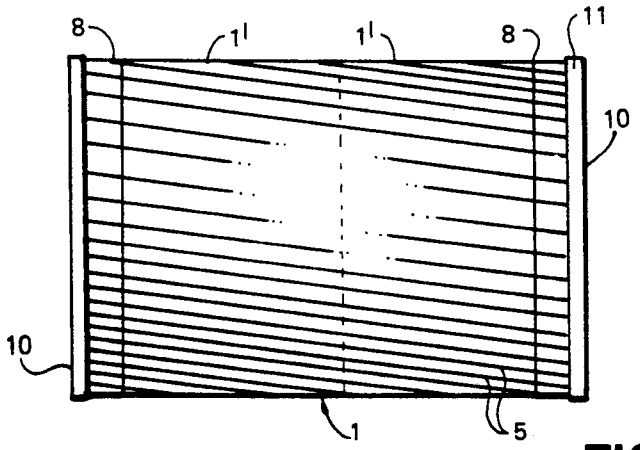
FIG. 9 is a schematic elevation of an assembled condition.
Figure 11:
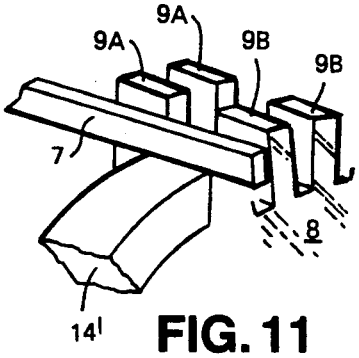

Instead of the arrangement of FIG. 8 for receiving, guiding and biassing ends of arms 9, FIG. 11 is a fragmentary detail of a modified guide ring assembly showing two parallel and aligned rows of arms 9A and 9B are provided extending from rings 8 similar to arms 9 but in two parts arranged as two rows one spaced from the other with the space therebetween having a resilient annular or like ring 14' to resiliently bias the ends of the ejector bars 7 outwardly. The ring 14' is preferably made of polyurethane. The arms 9 are generally of constant cross section without any undercutting or shaping which might weaken the structure of the arms.

Also, to reduce noise and wear, a polyurethane or like sleeve (not shown) is provided on the inner surface of end cap 10-preferably on the main disc like face thereof and along part of the inner surface of the rim or flange extending therefrom.

I claim:

1. An improved rotary cutter comprising a cylindrical body mountable so as to be rotatable about its central axis and having a plurality of spaced apart elongate slots or grooves defined by opposite side wall surfaces and a bottom surface and extending along the outer surface of said body and having a longitudinal central axis, and in which grooves there are secured a plurality of resilient cutting blades which are normally flat in their unstressed condition out of said grooves and have a longitudinal cutting edge along one side; each of said slots or grooves being curved when viewed in section perpendicularly tranverse to said longitudinal axis of said grooves and dimensioned such as to receive the edge of one said blades remote from the cutting edge and securely frictionally retain such by the reactive pressure resulting from the deformation or bending of said blade to assume the curve of said slot or groove when locating the blade therein.

2. A cutter as claimed in claim 1, in which the slots or grooves are helical about the rotary axis or formed as a helix to improve the cutting action and to act avoid or minimized overheating of the blades.

3. A cutter as claimed in claim 2, in which the curvature of the grooves is such as to incline the cutting edges of the blades in the direction of rotary movement of the cutter to achieve a more effective cutting angle.

4. A rotary cutter as claimed in claim 1 in which there is included a cylindrical body mountable to be rotatable about its cylindrical axis and having a plurality of spaced apart cutting blades located thereon and extending therealong and having a plurality of ejector bars mounted in the spaces between the blades and extending with said blades, each said ejector bar being mounted in the space between two adjacent blades so as to be displaceable towards the central axis during the cutting operation and away from the central axis and towards the cutting edge of the blade after the cutting operation so as to act to prevent or minimize the build up of cut material between the blades.

5. A cutter as claimed in claim 4 in which the ejector bars are displaceable in channels in the cylindrical body extending along the blades and forming the spaces between the blades with sufficient clearance for the bars to be freely displaceable.

6. A cutter as claimed in claim 4, in which the ejector bar are resiliently or spring biased into their outer position.

7. A cutter as claimed in claim 5, in which the ejector bars are spring biassed by spring means at each of their opposite ends which spring means each comprise a resilient or other damping means also acting to stop the inward movement of the ejector bar.

8. A cutter as claimed in claim 4, in which the ejector bars are guided at their opposite ends in guide rings located at opposite ends of the cylindrical body and each having a plurality of radial or part helical or other outwardly open channels formed around the outer surface and indexable or alignable with the spaces or channels between the blades in which the ejector blades are inwardly and outwardly displaceable and alignable so as to be extensions of the adjacent end portions of the slots or grooves or the blades therein i.e. preferably formed at the same pitch as the helical disposition of the blades.

9. A cutter as claimed in claim 8, in which an annular retaining end cap with a centrally directed flange is located at each end of the cylindrical body over each said ring with the flange closing part of the open channels of the guide ring so as to retain the ejector bars and limit outward displacement thereof-preferably to not beyond the outer cutting edge of the blades.

10. A rotary cutter according to claim 2, wherein said cylindrical body is formed in at least two parts with said grooves being alignable and held non-rotatably relative to each other to enable the blades to extend along the grooves in the same manner as a one piece cylindrical body.

11. A composite rotary cutter according to claim 2, having a cylindrical cutter body which is tubular and forming an outer sleeve, preferalby of hard steel, for an inner cylindrical mounting tube of mild steel to which it is secured, the outer sleeve being dimensioned sufficiently large as to enable the inner cylindrical mounting tube to be accordingly machined or formed so as to be mountable on an existing machine and the sizing of the outer sleeve being such as to permit variations in the inner mounting tube to be sufficient to accommodate the different mountings of existing machines.

12. A rotary cutter comprising an outer cylindrical sleeve having helically disposed grooves containing arcuately deformed resilient blades secured by the inherent spring pressure thereof and having displaceable ejector bars displaceable in the spaces between the blades with the ends of the bars guided and secured in aligned, slotted rings at each end of the sleeve and retained by annular end caps with said sleeve, rings and end caps being non-rotatably mounted on the inner mounting tube which is adapted to be mounted to be rotatable in a cutting apparatus, said grooves being curved when viewed in section perpendicular to the central longitudinal axis of said grooves.

13. An improved rotary cutter for cutting glass fibre strands comprising a generally elongate cylindrical metal body having a longitudinal central axis and mountable so as to be rotatable about said central axis and said body having a plurality of spaced apart elongate slots or grooves extending longitudinally along its outer surface and having a longitudinal axis, in each of which grooves there is secured an elongate cutting blade or resilient metal each of which blades being normally flat in its unstressed condition prior to location in said groove and has a longitudinal cutting edge along one longitudinal side; each of said grooves being defined longitudinally by two side walls which are interconnected at the bottom of the groove most proximate said central axis by a bottom wall with each said side wall being similarly curved when viewed in section perpendicularly transverse to said central axis and to the longitudinal axis of the central groove and being dimensioned and spaced apart relative to the dimensions of said blade such as to receive the edge and adjacent mounting portion of one said blades remote from the cutting edge and securely frictionally retain said blade therein solely by frictional effect of the reactive pressure resulting from the bending of said blade to assume the curvature of said side walls defining said groove upon location of said blade in said groove.

14. A cutter as claimed in claim 13, wherein each of said grooves extend helically along the body and about the rotary axis.

15. A cutter according to claim 14, wherein the pitch of the helix of said grooves is approximately 5° to said central axis.

16. A cutter according to claim 13, wherein said side walls have identical curvature and said blades are inclined at an acute angle relative to the radius of said cylindrical body and in the normal direction of rotation of said body.

17. A cutter according to claim 13, wherein a plurality of elongate ejector bars are disposed around said body extending longitudinally thereof and beyond the ends thereof and one said ejector bar being located in the space between adjacent blades and radially displaceable therein relative to said central axis towards and away therefrom to prevent or minimize the build up of cut fibre strands between the blades; and mounting means for mounting said ejector bars in free floating manner, comprising a guide and mounting ring mounted coaxially on each opposite end of said cylindrical body and comprising an annular main body having a plurality of projections extending outwardly from said main body and circumferentially therearound to form a castellated-like outer surface with the spaces between said projections being aligned with the spaces between the blades; said mounting means also comprising a disc-like end cap at each end of the cutter with each end cap having a circumferential concentric flange extending on one side and being such as to be locatable to encircle the outer ends of said projections of said mounting ring and such as to retain the free ends of said ejector bars displaceably located between said projections to restrict the outward movement of said ejector bars and retain said bars between said blades.

18. A cutter according to claim 17, wherein a resilient damping means is provided at each end of the cutter between the ends of said ejector bars and the main body of said ring to bias said ejector bars outwardly following a damping or shock absorbing action upon radially inward displacement of said bars during a cutting operation.

19. A cutter according to claim 18, wherein two spaced apart, aligned rows of projections are provided on each mounting ring and said damping means is provided in said space therebetween.

20. A cutter according to claim 19, wherein said biassing means is an annular ring of resilient material.

21. A cutter according to claim 13, wherein further ejector bar-receiving grooves are provided in said body running parallel to said grooves for the blades and wherein said ejector bars are displaceable in said further groove.

22. A cutter according to claim 21, wherein said grooves for said blades and said further grooves or flutings are helically disposed on said cylindrical body.

23. A cutter according to claim 20, wherein a coil or annular metal spring is located between the end of said ejector bars and said annular ring.

24. A cutter according to claim 17, wherein the radially inner surface of said flange of the end cap and the disc surface of said end cap juxtaposed said mounting ring has a surface coating to restrict wear and noise resulting from reciprocating displacement of said ejector bars.

25. A cutter according to claim 13, wherein the spacing of saif side walls is slightly greater than the width of each said blade.

* * * * *